United States Patent [19]

O'Sullivan et al.

[11] Patent Number: 4,745,718

[45] Date of Patent: May 24, 1988

[54] PRESTRESSED STRUCTURAL SUPPORT AND METHOD FOR MAKING SAME

[75] Inventors: Kevin B. O'Sullivan; Arthur L. Troutner, both of Boise, Id.

[73] Assignee: Trus Joist Corporation, Boise, Id.

[21] Appl. No.: 868,952

[22] Filed: May 30, 1986

[51] Int. Cl.[4] ..... E04B 5/12; E04C 3/14

[52] U.S. Cl. ..... 52/223 R; 52/86; 52/227; 52/720; 52/730

[58] Field of Search ..... 52/86, 223 R, 227, 222, 52/291, 720, 729, 730

[56] References Cited

U.S. PATENT DOCUMENTS

| | | | |
|---|---|---|---|
| 1,606,769 | 11/1926 | Miller | 52/86 |
| 1,762,363 | 6/1930 | Sergent | 52/86 |
| 2,039,398 | 5/1936 | Dye | 52/223 R X |
| 2,342,916 | 2/1944 | Blaski | 52/86 |
| 3,294,608 | 12/1966 | Peterson . | |
| 3,686,809 | 8/1972 | Lindal | 52/223 R |
| 3,849,963 | 11/1974 | Harmon | 52/227 X |
| 3,860,687 | 1/1975 | Bernander et al. | 52/223 R X |
| 4,500,378 | 2/1985 | Reppel et al. . | |

*Primary Examiner*—David A. Scherbel
*Assistant Examiner*—Richard E. Chilcot, Jr.
*Attorney, Agent, or Firm*—Kolisch, Hartwell & Dickinson

[57] ABSTRACT

The invention comprises an improved structural support member, and method for making the same, having bonded wood beam members which are prestressed during the bonding process. The prestressing is such that significant stresses are induced in an outer surface in at least one of the beam members and at least partially retained by the cured bond. The stresses are such that a significant compression prestress is induced at the bottom surface of the structural support whereby it is capable of carrying a much greater load represented by the compression prestress at the bottom surface.

21 Claims, 1 Drawing Sheet

PRESTRESSED STRUCTURAL SUPPORT AND METHOD FOR MAKING SAME

BACKGROUND OF THE INVENTION

This invention relates generally to structural support members and more particularly to prestressed and cambered structural support members.

It is well-known that the load capacity of structural supports such as beams can be increased by prestressing. The prestress is imparted to the beam in a direction opposite to the direction of the stress resulting from the eventual load. When so prestressed, a compression stress is induced at the lower surface of the beam and a tension stress induced at the upper surface of the beam. Both of the stresses are along a line parallel to the length of the beam. The prestress in the beam will be taken up in the loaded condition before the load acting on the beam causes a tension stress to be imparted at the beam lower surface. Accordingly, a prestressed beam is able to carry a greater load than a non-prestressed beam of the same cross section.

This concept has been employed in the making of compound wooden bonded structures commonly used in building construction. One example, is in the form of horizontally laminated board structures commonly referred to as "glue lam" beams. Such beams are comprised of a plurality of one and one-half to two inch thick laminates which are glued together. In making such a structure, adhesive is applied to the laminates which are then bent in a direction opposite to the directon of the future load. When the adhesive cures, the bending forces are removed and the bend, or camber, is maintained by the cured adhesive.

Such a beam can carry an additional load over a non-cambered beam of the same cross section. The additional load is represented by the load required to overcome the bending stress in compression at the bottom surface of the cambered beam. However, the amount of this compression stress is slight, as very little force is required to bend the laminates to the desired camber. Therefore, the compression stress at the bottom of the beam retained by the cured adhesive is very small compared to a design load stress of a noncambered beam of the same cross section. Accordingly, such a beam has only a minimal degree of prestress for stopping sagging in later use.

Of course, the degree of prestressing can be increased by increasing the camber. However, there are practical limits to the degree of cambering which are dictated by the required installed configuration of the beam. The amount of camber is also limited by the degree to which the laminates can be bent before failing. Heretofore, to support significant loads over great distances with horizontally laminated beams having industry acceptable degrees of camber, the beam size is simply increased until the desired load can be carried.

Increasing the prestress in beams has also been attempted in ways such as shown in U.S. Pat. No. 3,294,608 to Peterson. Peterson discloses a cambered beam having a wooden beam which overlies a comparatively thin tension element made of metal. In making such a beam, the adhesive is applied between the members and then the tension element is longitudinally stressed. After the adhesive cures, the longitudinal tension forces are removed thus prestressing the beam. The Peterson patent alleges that such a structure may be capable of carrying a load one hundred percent greater than that of a non-prestressed beam. However, such a structure is difficult and expensive to manufacture and therefore not believed to be practical.

In another process used in making compound bonded wooden structures, the cross section of the beam is made from three separate parts. The middle part is thicker than the outer parts and pre-bent by steam in a direction opposite to the eventual load. The outer two parts are bent in the opposite direction, the direction of the eventual load. The members are then straightened and bonded together resulting in a straight, prestressed beam. For example, U.S. Pat. No. 2,039,398 to Dye discloses such a beam wherein the top and bottom members are tension and compression prestressed respectively by applying appropriate longitudinal forces. However, the Dye structure is shown as either being straight or having a camber in the direction of the load. Additionally, steaming beams to cause them to bend and thereafter gluing them together is not practical. It would be very difficult to control the steaming process to produce repeatable curvature of the members for a given time period of steaming, etc.

Another structure prestressed by imparting longitudinal forces to interconnected beam members is disclosed in U.S. Pat. No. 4,500,378 to Reppel et al. However, it is very difficult to longitudinally impart significant stresses in the individual beams. The Reppel et al. process and apparatus for so doing are very complex.

SUMMARY OF THE INVENTION

It is an object of the present invention to provide a prestressed and cambered structural support member, and method for making the same, which is capable of carrying significantly greater loads than a non-prestressed beam of the same cross section.

Another object of the present invention is to provide such a prestressed structural support member which is capable of carrying such greater loads while retaining an industry acceptable degree of cambering.

Yet another object of the present invention is to provide such a prestressed structural support member capable of being trimmed at its ends without causing damage to the support member.

The invention comprises an improved structural support member, and method for making the same, having bonded members which are prestressed during the bonding process such that significant stresses are induced in an outer surface in at least one of the members and at least partially retained by the cured bond.

These and other objects, features and advantages of the present invention will become more readily understood from the following detailed description of preferred embodiments which proceeds with reference to the accompanying drawings.

DETAILED DESCRIPTION OF PREFERRED EMBODIMENTS

Figure 1A:
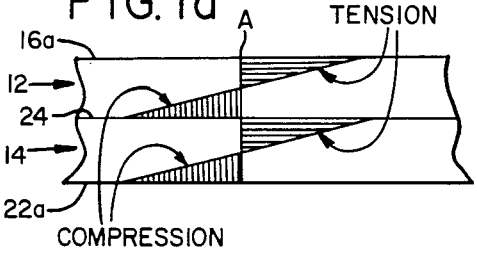
FIG. 1*a* and 1*b* are stress diagrams of the FIG. 1 embodiment.
Figure 1B:
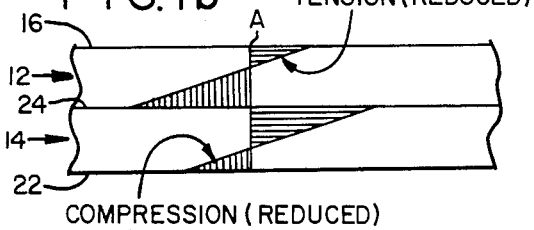
Figure 1:
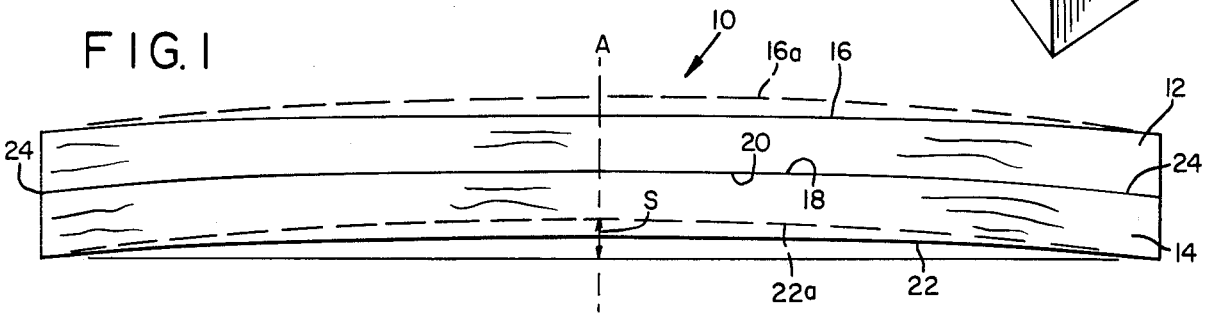
FIG. 1 is a side view of one embodiment of a prestressed and cambered structural support member in accordance with the invention.

The invention can best be understood with reference to the embodiment depicted in FIG. 1. As shown, the structural support member 10 is comprised of a first elongate beam member 12 which overlies a second elongate beam member 14. The beam members are joined together along an adhesive bond joint 24 extending the length of and between the members. Although not necessary as explained below, beam members 12, 14 as shown are of the same height. Each beam member 12, 14 has a top surface 16, 18 respectively, and a bottom surface 20, 22 respectively. As shown, both beam members 12, 14 are curved and stressed the result of being curved and bonded together by adhesive joint 24 extending the length of the beam members between surfaces 18, 20.

The support member 10 is prestressed in its manufacture by applying an adhesive such as a gap filling phenol resorsinol adhesive between beam members 12 and 14 to form adhesive joint 24. Before the adhesive appreciably cures, the central portion of beam 10 is deflected by imparting transverse bending forces until the beam has a cambered profile represented by the dashed lines 16*a*, 22*a* in FIG. 1. As shown, the cambered profile is circular over the length of the beam, with the greatest offset "S" being at the center of the beam along line "A". Alternative cambered profiles are also usable within the scope of the invention as described below.

Referring to FIG. 1*a*, this bending to form the cambered profile 16*a*, 22*a* induces stresses in beam members 12, 14 which vary from zero at the ends of the beam to a maximum at mid-span. The stress at top surface 16*a* is a tension stress while the stress at bottom surface 22*a* is a compression stress, as shown.

After the adhesive has cured, the external transverse bending forces are removed causing beam 10 to lose some of its curvature and to be shaped as represented by solid outer surface lines 16, 22. The removing of the external forces causes an internal sear stress to be imparted in th cured adhesive which retains a reduced portion of the residual compression and tension stresses along surfaces 22, 16 respectively. The stresses in the beam 10 in this prestressed condition are shown in FIG. 1*b*. As is readily apparent, the internal tension and compression stresses at the adhesive line at top and bottom surfaces 18 and 20 of beam members 14, 12 respectively, retained by the adhesive in shear stress exceed the reduced stresses at the top and bottom surfaces 16, 22 of the finished beam 10. This makes possible the carrying of significantly greater loads than that carryable by a non-prestressed beam of the same cross section.

The additional load carryable by the prestressed beam of the present invention over that of a beam not prestressed is represented by the residual stress in compression at bottom surface 22 in FIG. 1*b*. This retained residual stress has been discovered to have a significant effect in increasing the load carrying capability of the support when the height of the bottom member is at least six inches high. Adhesively bonded and cambered beams of the prior art, on the other hand, have lower beam members of much less height which is typically 1.5 inches high for a "glue lam" beam, and accordingly do not result in a significant increase in the design stress of the beam.

For example, the potential increase in design stress for a prestressed beam in accordance with the invention is believed to be up to 2500 pounds per square inch at the center of the beam while that for a "glue lam" beam is typically 10 to 50 pounds per square inch which is negligible. The increase in design stress for "glue lams" is typically negligible because very little force is required to bend the laminates to the desired camber profile. Accordingly, with "glue lams" there is very little bending stress to be retained by the adhesive lines. However, a beam of a given size and camber constructed in accordance with the invention is capable of carrying much greater loads than "glue lam" beams because of the retention of significant prestresses by an adhesive joint. Alternatively, a beam of a smaller size is usable to carry loads that larger prior art beams would have had to carry. The increased design stress for beams of the present invention will depend on the height of the bottom member and industry acceptable degree of cambering.

Figure 4:
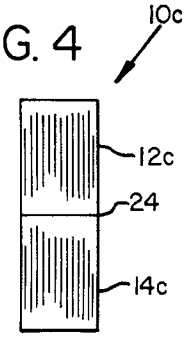
FIG. 4 is a vertical section view of another modification of the FIG. 1 embodiment.
Figure 3:
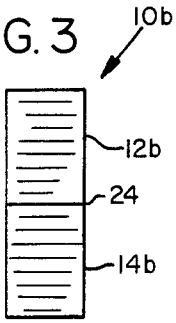
FIG. 3 is a vertical section view of a modification of the FIG. 1 embodiment.
Figure 2:
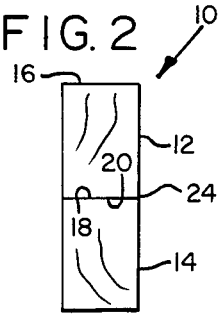
FIG. 2 is a vertical section view of the FIG. 1 embodiment.

As depicted in FIGS. 2–4, beam members 12 and 14 can be comprised of any of three different types of beam members. FIG. 2 shows each beam member 12, 14 comprised of a solid piece of lumber. FIG. 3 shows each beam member 12*b*, 14*b* comprised of a horizontally laminated structure made of a plurality of thin laminates one and one-half inches thick. FIG. 4 shows each beam member 12*c*, 14*c* comprised of vertically laminated veneer lumber. Other forms of beam members could also be used without departing from the principles of the invention. It would also be possible to combine different forms of beam members such as a horizontally laminated beam member atop a vertically laminated beam member.

The retention of a significant residual stress at bottom surface 22 of beam member 14 requires the establishment of a rigid, high quality bond between the beam members. For example, when vertically laminated lumber is edge-glued together as depicted in FIG. 4, an adhesive with good gap filling characteristics and whose bond does not require the application of high pressure, is recommended. One suitable wood adhesive having these characteristics, and preferred for all applications, is a gap filling phenol resorsinol adhesive. Other adhesives might also be usable.

When the heights of beam members 12 and 14 are equal, the prestress at the top 16 of top member 12 will be a tension stress while the stress at the bottom 22 of lower member 14 will be an equal but opposite compression stress (See FIG. 1*b*). It is possible to change the tension stress to a compression stress and vice versa by changing the comparative heights of the beam members. It is preferable to maintain a residual compression stress at the bottom of the lower member. This is because a beam stressed beyond its limits generally fails in tension at the bottom surface first.

When the height of top beam member 12 is less than the height of lower beam member 14, it is possible to reduce the residual tension stress at the top surface 16 to zero and even to create a compression prestress at the top surface. It has been determined that the residual tension stress at top 16 of the top member becomes zero when the ratio defined by the height of beam member 12 to the height of beam member 14 is equal to onehalf. As this ratio decreases below one-half, the residual stress at the top of the top member becomes a compression stress. It is preferable that the top member be lesser in height than the bottom member to concentrate the compressive forces in the lower half of beam 10 as it is the lower half of the beam which would be first to fail in an overload condition.

Figure 5:
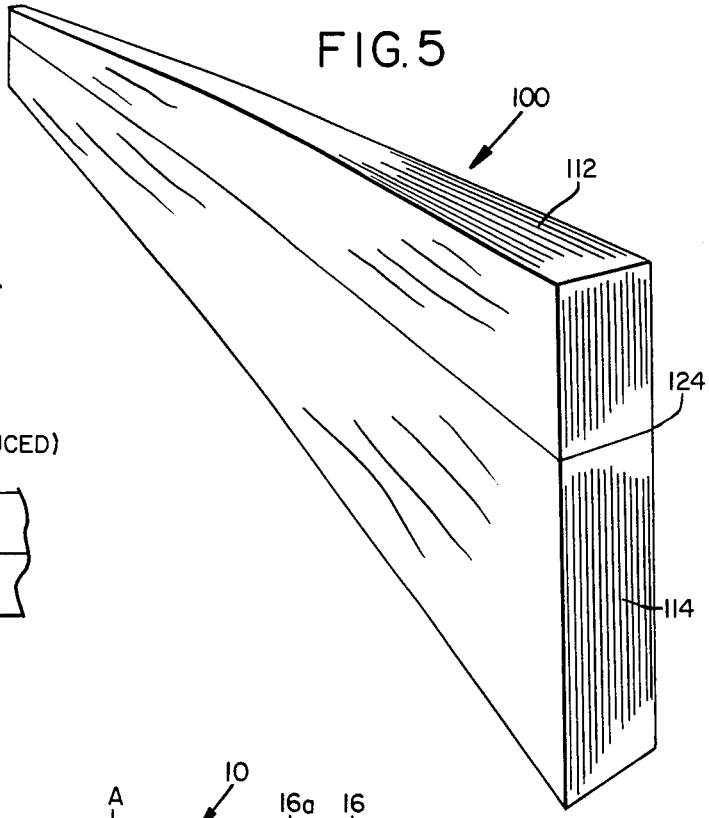
FIG. 5 is a perspective view of a second embodiment of a prestressed and cambered structural support member in accordance with the invention.
Figure 6:
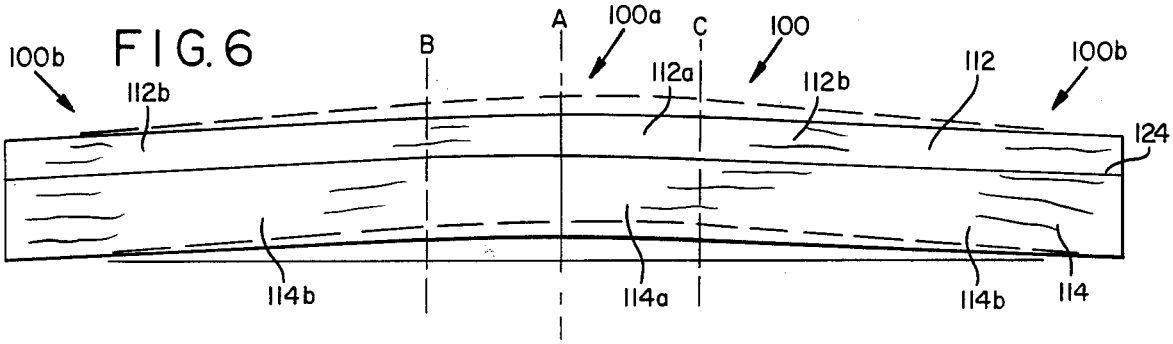
FIG. 6 is a side view of the FIG. 5 embodiment.

A second embodiment of the invention is depicted in FIGS. 5 and 6. The components of the FIGS. 5 and 6 embodiment are similar to the FIG. 1 embodiment such that only the differences will be discussed. As shown, the second embodiment support member 100 is comprised of two beam members 112, 114 bonded together, each of vertically laminated veneer lumber. The top beam member 112 is one-half the height of the bottom beam member 114. Referring to FIG. 6, beam member 100 can be viewed as divided into an intermediate portion **100*a* between lines B and C, which separates two end portions 100*b***.

The second embodiment support member 100 is prestressed in manufacture in a manner similar to the first. However, in the second embodiment, first and second beam members 112, 114 are curved about their intermediate portions **112*a*, 114*a* while their end portions 112*b*, 114*b* are kept substantially straight. When so stressed, with the bending forces being removed after the adhesive has cured, the retained compression stress at the bottom surface 122 will be a maximum along the intermediate portion 100*a* and a minimum along the straight end portions 100*b***. (The shear stress will be maximum at the point of greatest offset where line A meets the bottom surface of the beam.) In fact, the shear stress at the adhesive line in the straight end portions would be near zero enabling the straight end portions to be cut if necessary.

Such is not believed to be the case with a prestressed beam curved about its entire length. When so curved, the stress at the adhesive line can be so great that the beam might split when attempting to cut through the adhesive joint. Accordingly, the FIGS. 5, 6 embodiment has the advantage of being able to set up different length prestressed beams in the same forming jig. In the FIG. 1 embodiment, a separate positioning of the forming jig must be employed for each different length beam to effect curvature about the entire beam length. Additionally with the second embodiment, ends of the beam can be trimmed at the job site, if necessary, to provide the proper length.

Also, the FIGS. 5, 6 embodiment is believed to have twice the increased load carrying capability of a prestressed and cambered beam of the same dimension which is curved over its entire length. This is caused by bending the center of the beam to a tighter radius or degree of curvature at the middle of the beam. Because the ends of the beam are straight, the overall camber of the beam will be less than the degree of curvature in the intermediate portion. The result is a beam having the residual stresses concentrated where needed most, in the central portion of the beam, all while maintaining an industry acceptable degree of camber.

Preferably, transverse bending forces are applied to the intermediate portion to produce a parabolic curve. Such a profile has been discovered to produce the greatest beneficial residual stress in the intermediate portion resulting in the greatest load carrying capability increase. Alternatively, a circular or other curve could be employed without departing from the invention.

Also as depicted in FIGS. 5, 6 and described above, the ratio of the height of the top member to the bottom member is equal to one-half. Accordingly, as mentioned above, there will be no residual stress at the top surface of first beam member 112. The residual stress at the bottom surface of beam 114 will be a compression stress.

EXAMPLES

Below are examples of residual stresses near the longitudinal center of the inventive prestressed beams. Each beam is cambered to a parabolic curve over a center twenty foot section with straight end sections extending therefrom. In every example, the top and bottom beam members are made of vertically laminated veneer lumber which are edge-glued together with a gap filling phenol resorsinol adhesive, such as depicted in FIGS. 5, 6. The standard parabolic profile used is:

$$Y=(S'/500)X^2$$

where S' represents the camber curve constant; X the distance from midspan, and Y the offset from the midspan.

A beam having a top member with a height of eight (8) inches and a bottom member with a height of twelve (12) inches, and S' equal to two (2) will have a finished bending prestress in compression at the center of the bottom surface of the beam equal to 430 pounds per square inch. The prestress in tension at the top center of the beam will be 161 pounds per square inch. Such a prestressed beam is capable of carrying an additional stress at the center of the beam over a beam of the same cross section not prestressed, of 430 pounds per square inch.

Another beam having a top member eight (8) inches in height, a bottom member sixteen (16) inches in height, with S' equal to four (4), will have a finished compression prestress at the center of the bottom surface of the beam equal to 1,075 pounds per square inch. The residual tension prestress at the top center of the beam will be equal to zero because of the ratio of the top member height to the bottom member height being equal to one-half. Such a prestressed beam is capable of carrying an additional stress at the center of the beam over a beam of the same cross section not prestressed and cambered, of 1,075 pounds per square inch.

In yet another beam having a top member eight (8) inches in height, a bottom member twenty (20) inches in height and S' equal to six (6), the residual prestress in compression at the center of the bottom surface of the beam will be 1,843 pounds per square inch. Since the ratio of the top member height to the bottom member height is less than one-half, the residual prestress at the top center of the beam will be a compression prestress and will be equal to 576 pounds per square inch. Such a prestressed beam is capable of carrying an additional stress at the center of the beam over a beam of the same cross section not prestressed, of 1,843 pounds per square inch.

In still another beam having a top member twenty (20) inches in height, a bottom member twentyfour (24) inches in height and S' equal to six (6), the residual prestress in compression at the center of the bottom surface of the beam will be 2,566 pounds per square inch. The prestress in tension at the top center of the beam will be 1,759 pounds per square inch. Such a prestressed beam is capable of carrying an additional stress at the center of the beam over a beam of the same cross section not prestressed, of 2,566 pounds per square inch.

Having illustrated and described the principles of our invention with reference to several preferred embodiments, it should be apparent to those persons skilled in the art that such invention may be modified in arrangement and detail without departing from such principles. We claim as our invention all such modifications as come within the true spirit and scope of the following claims.

We claim:

1. A prestressed and cambered structural support member in unloaded condition comprising:

a first elongate beam member having a top surface and a bottom surface and having two opposite end portions separated by an intermediate portion, the intermediate portion being curved and the two end portions being substantially straight;

a second elongate beam member underlying the first elongate beam member, the second beam member having a top surface and a bottom surface and having two opposite end portions separated by an intermediate portion, the intermediate portion being curved and the two end portions being substantially straight;

the intermediate portion of the bottom surfaces of the first and second beam members being stressed in compression to an extent greater than any compression in the top surfaces thereof; and adhesive bond means for adhesively bonding the curved intermediate portions and end portions of the first and second beam members together by an adhesive joint extending between the beam members without the use of metal fasteners, the adhesive joint retaining a residual stress at the bottom surface of the second beam member resulting from its intermediate portion being curved, the retained residual stress being maximum at a mid location of curvature in the intermediate portion and a minimum in the substantially straight outer end portions, whereby the structural support member is prestressed and cambered.

2. The prestressed structural support member of claim 1 wherein the first and second beam members comprise longitudinally laminated lumber.

3. The prestressed structural support member of claim 1 wherein the first and second beam members comprise vertically oriented laminated veneer lumber.

4. The prestressed structural support member of claim 1 wherein the curved intermediate portions of both beam members comprise parabolic curves.

5. The prestressed structural support member of claim 1 consisting of no more beam members than the two first and second elongate beam members.

6. The prestressed structural support of claim 1 wherein the intermediate portion of the first beam member is stressed, the adhesive joint retaining a residual stress at the top surfce of the first beam member resulting from its intermediate portion being curved, the residual stress at the top surface of the first beam member being a tension stress, the residual stress at the bottom surface of the second beam member being a compression stress.

7. The prestressed structural support of claim 1 wherein the intermediate portion of the first beam member is stressed, the adhesive joint retaining a residual stress at the top surface of the first beam member resulting from its intermediate portion being curved, the residual stress at the top surface of the first beam member being a compression stress, the residual stress at the bottom surface of the second beam member being a compression stress.

8. The prestressed structural support member of claim 1 wherein the first beam member has a height which is less than the height of the second beam member.

9. The prestressed structural support member of claim 1 wherein, the first and second beam members comprise longitudinally laminated veneer lumber;

the first beam member having a first height, the second beam member having a second height which is greater than the first height; and wherein the curved intermediate portions of both members comprise parabolic curves.

10. The prestressed structural support member of claim 9 wherein the first and second beam members comprise vertically oriented laminated veneer lumber.

11. The structural support member of claim 1, further comprising at least one additional elongate beam member adhesively bonded to one of the first and second elongate beam members, wherein said additional elongate beam member has a top surface and a bottom surface, with the bottom surface being stressed in compression to an extent greater than the top surface thereof.

12. A prestressed and cambered structural support member in unloaded condition comprising:

a first elongate beam member comprised of vertically oriented laminated veneer lumber having a top edge surface and a bottom edge surface and having a curved central portion;

a second elongate beam member comprised of vertically oriented laminated veneer lumber having a top edge surface and a bottom edge surface, the second beam member underlying the first beam member and having a curved central portion;

the central portion of the bottom edge surfaces of the first and second beam members being stressed in compression to an extent greater than any compression in the top surfaces thereof; and adhesive bond means for adhesively bonding the first and second elongate beam members together, including the curved central portion, by an adhesive joint extending between the beam members without the use of threaded metal fasteners, the adhesive joint retaining a residual stress in at least the bottom edge surface of the second beam member resulting from its central portion being curved, whereby the structural support member is prestressed.

13. The prestressed structural support member of claim 12 wherein the curved central portions comprise parabolic curves.

14. A prestressed and cambered structural support member in unloaded condition comprising:

a first elongate beam member having a top surface and a bottom surface and having a curved central portion as well as two opposite end portions which are substantially straight;

a second elongate beam member underlying the first elongate beam member having a top surface and a bottom surface and having a curved central portion as well as two opposite end portion which are substantially straight and a height which is at least six inches;

the central portion of the bottom surfaces of the first and second beam members being stressed in compression to an extent greater than any compression in the top surfaces thereof; and adhesive bond means for adhesively bonding the first and second elongate beam members together, including the curved central portions, by an adhesive joint extending between the beam members, the adhesive joint retaining a residual stress in at least the bottom surfce of the second beam member resulting from its central portions being curved without the use of metal fasteners, whereby the structural support member is prestressed.

15. The prestressed structural support member of claim 14 wherein the height of the second beam member is at least eight inches.

16. The prestressed structural support member of claim 14 wherein the curved intermediate portions of both beam members comprise parabolic curves.

17. The prestressed structural support member of claim 14 wherein the first beam member has a height which is less than the height of the second beam member.

18. The prestressed structural support of calim 14 wherein the intermediate portion of the first beam member is stressed, the adhesive joint retaining a residual stress at the top surface of the first beam member resulting from its intermediate portion being curved, the residual stress at the top surface of the first beam member being a tension stress, the residual stress at the bottom surface of the second beam member being a compression stress.

19. The prestressed structural support of claim 14 wherein the intermediate portion of the first beam member is stressed, the adhesive joint retaining a residual stress at the top surface of the first beam member resulting from its intermediate portion being curved, the residual stress at the top surface of the first beam member being a compression stress, the residual stress at the bottom surface of the second beam member being a compression stress.

20. The prestressed structural support member of claim 14 wherein the first and second beam members comprise longitudinally laminated lumber.

21. The prestressed structural support member of claim 14 wherein, the first and second beam members comprise longitudinally laminated veneer lumber;

the first beam member having a first height, the second beam member having a second height which is greater than the first height; and wherein the curved intermediate portions of both members comprise parabolic curves.

* * * * *